US007299654B2

(12) United States Patent
Ben Yahia

(10) Patent No.: US 7,299,654 B2
(45) Date of Patent: Nov. 27, 2007

(54) PRESSURE-REDUCING DEVICE FOR AN AIR-CONDITIONING CIRCUIT

(75) Inventor: Mohamed Ben Yahia, Paris (FR)

(73) Assignee: Valeo Climatisation, S.A., LaVerriere (FR)

( * ) Notice: Subject to any disclaimer, the term of this patent is extended or adjusted under 35 U.S.C. 154(b) by 485 days.

(21) Appl. No.: 10/852,050

(22) Filed: May 24, 2004

(65) Prior Publication Data

US 2004/0237548 A1 Dec. 2, 2004

(30) Foreign Application Priority Data

May 27, 2003 (FR) ..... 03 06424

(51) Int. Cl.
*F25B 41/06* (2006.01)

(52) U.S. Cl. ..... 62/527; 236/92 B

(58) Field of Classification Search ..... 62/222, 62/509, 511, 527; 236/80 F, 92 B, 92 R; 137/510, 542
See application file for complete search history.

(56) References Cited

U.S. PATENT DOCUMENTS 3,399,543 A * 9/1968 Matthies ..... 62/202
5,002,089 A * 3/1991 Reedy et al. ..... 137/493.8
5,004,008 A * 4/1991 Drucker ..... 137/504
5,170,638 A * 12/1992 Koenig et al. ..... 62/204
5,214,939 A * 6/1993 Drucker et al. ..... 62/527
5,941,086 A * 8/1999 Petrulio et al. ..... 62/202
6,131,606 A * 10/2000 O'Neill ..... 137/495
6,481,229 B1 * 11/2002 Yajima et al. ..... 62/225

FOREIGN PATENT DOCUMENTS

| | | | |
|---|---|---|---|
| EP | 0279 622 | A1 | 8/1988 |
| EP | 0786 632 | A2 | 7/1997 |
| EP | 1 134 467 | A1 | 9/2001 |
| EP | 1 143 212 | A1 | 10/2001 |
| FR | 2 780 143 | A | 12/1999 |
| JP | 11148576 | | 6/1999 |
| JP | 2001108310 | | 4/2001 |
| JP | P2001-280721 | A * | 10/2001 |
| WO | WO 01/06183 | | 1/2001 |
| WO | WO 01/63185 | | 8/2001 |

* cited by examiner

*Primary Examiner*—Mohammad M. Ali
(74) *Attorney, Agent, or Firm*—Howard & Howard Attorneys, P.C.

(57) ABSTRACT

The invention proposes a pressure-reducing device designed to be installed in an air conditioning circuit operating with cooling fluid (FR) and including a housing suited to be traversed by cooling fluid under the control of a needle valve (134). The pressure-reducing device moreover includes a bulb (200) filled with a control fluid (FC) exerting a control pressure on a membrane (33) as a function of ambient conditions, the aforementioned membrane being suitable for acting on the needle valve as a function of the control pressure. The bulb is placed in the path of cooling fluid between the outlet of the condenser and the inlet of the pressure-reducing device.

11 Claims, 5 Drawing Sheets

PRESSURE-REDUCING DEVICE FOR AN AIR-CONDITIONING CIRCUIT

FIELD OF THE INVENTION

The invention concerns air conditioning circuits, especially for motor vehicles.

BACKGROUND OF THE INVENTION

The classical air conditioning circuit includes a compressor, a condenser, a pressure-reducing device and an evaporator, through which, in that order, a cooling fluid flows. The cooling fluid is compressed in a gaseous state and brought to a high pressure by the compressor. It is subsequently transformed into a liquid state by the condenser, then subjected to a drop in pressure in passing through the pressure-reducing device. The liquid is partially evaporated in the pressure-reducing device while cooling. Upon leaving the pressure-reducing device, the cooling fluid is in the form of a mixture of vapor and liquid at low pressure which is transmitted to the evaporator, where it is transformed into a gaseous state.

In existing constructions, a thermostatic pressure reducer is used to implement the pressure reduction. Such a pressure reducer is intended to input to the evaporator in an optimal manner while maintaining a selected overheat at the evaporator outlet; this enables the flow rate of the cooling fluid circulating in the circuit to be adjusted according to the heat loads.

Nonetheless, connection of such a pressure reducer to other elements of the air conditioning circuit is costly. In fact, such a pressure reducer includes four connecting points, two of said connection points being located on a lateral face for connection to the evaporator inlet and the evaporator outlet via two connection conduits, and the other two connection points being located on the other lateral face for connection to the condenser outlet (or the accumulator outlet) and the condenser inlet via two other connection conduits. Furthermore, at least two fixation clamps are necessary to fix the connection conduits together. The centerline distance of alignment of the two connection conduits located on the same lateral face must be strictly observed, and, in particular, the two connection conduits used to connect the pressure reducer to the evaporator inlet and outlet must have a specific and complex shape in order to enable the connection. This, in turn, increases the overall cost of the pressure reducer.

In other constructions, the pressure-reducing device is a calibrated orifice. Such a pressure-reducing device can easily be connected to the rest of the air conditioning circuit, in view of the simplicity of its structure. Nevertheless, the performance of a calibrated orifice for regulating the flow of cooling fluid as a function of thermal loads is not in line with that of thermostatic pressure reducers. This being the case, an accumulator is used as a complementary device at the evaporator outlet to prevent a too-high flow rate of cooling fluid from reaching the evaporator and to avoid surges of liquid at the compressor. This accumulator corresponds to a storage area for the non-circulating batch of cooling fluid. This storage area can increase or decrease as a function of operating conditions. As a consequence, the accumulator must be particularly voluminous, which increases the overall dimensions of the air conditioning installation.

SUMMARY OF THE INVENTION

The invention is intended to improve the situation.

For this purpose, it proposes a pressure-reducing device designed to be installed in an air conditioning circuit operating with a cooling fluid, whereby said pressure-reducing device includes a housing suitable for being traversed by the cooling fluid under the control of a needle valve. The pressure-reducing device further includes a bulb filled with control fluid exerting a control pressure on a membrane as a function of ambient conditions. Said membrane is suitable for acting on the needle valve as a function of control pressure. Advantageously, the bulb is placed in the path of the cooling fluid between the condenser outlet and the pressure-reducing device inlet.

According to another aspect of the invention, the control fluid presents a saturation pressure greater than or equal to the saturefation pressure of the cooling fluid at a given temperature.

The difference in pressure between cooling fluid and control fluid is thus basically constant over a temperature range between 10° C. and 70° C.

In particular, the control fluid is the fluid R218.

By way of variation, the control fluid is the fluid R134*a*.

The body includes an inlet suitable for being connected to the condenser by a conduit to receive the cooling fluid, and an outlet suitable for being connected to the evaporator by another conduit, in order to transmit the cooling fluid to it.

The body can further include a first compartment from which the inlet opens and a second compartment from which the outlet opens, the cooling fluid being transmitted from the first compartment to the second compartment by an opening, the passage section whereof is adjusted by the needle valve.

In particular, the bulb is located in the first compartment.

The needle valve is located in the first compartment beneath the bulb and includes a control rod (140) mechanically connected to the membrane so as to be mobile in translation as a function of the pressure exerted by the control fluid on the membrane.

The invention also proposes an air conditioning circuit operating with a cooling fluid, including a compressor, a condenser, a pressure-reducing device and an evaporator. Advantageously, the pressure-reducing device is as defined above. Its inlet is connected to the condenser and its outlet is connected to the evaporator.

The air conditioning circuit can include an accumulator placed between the evaporator outlet and the compressor inlet.

BRIEF DESCRIPTION OF THE DRAWINGS

Other characteristics and advantages of the invention will become apparent upon examination of the detailed description below and the appended drawings, wherein.

The drawings basically contain elements of a specific character. Accordingly, they may be used not only to make the description better understood but also to contribute to the definition of the invention, as the case requires.

DETAILED DESCRIPTION OF THE PREFERRED EMBODIMENTS

Figure 1A:
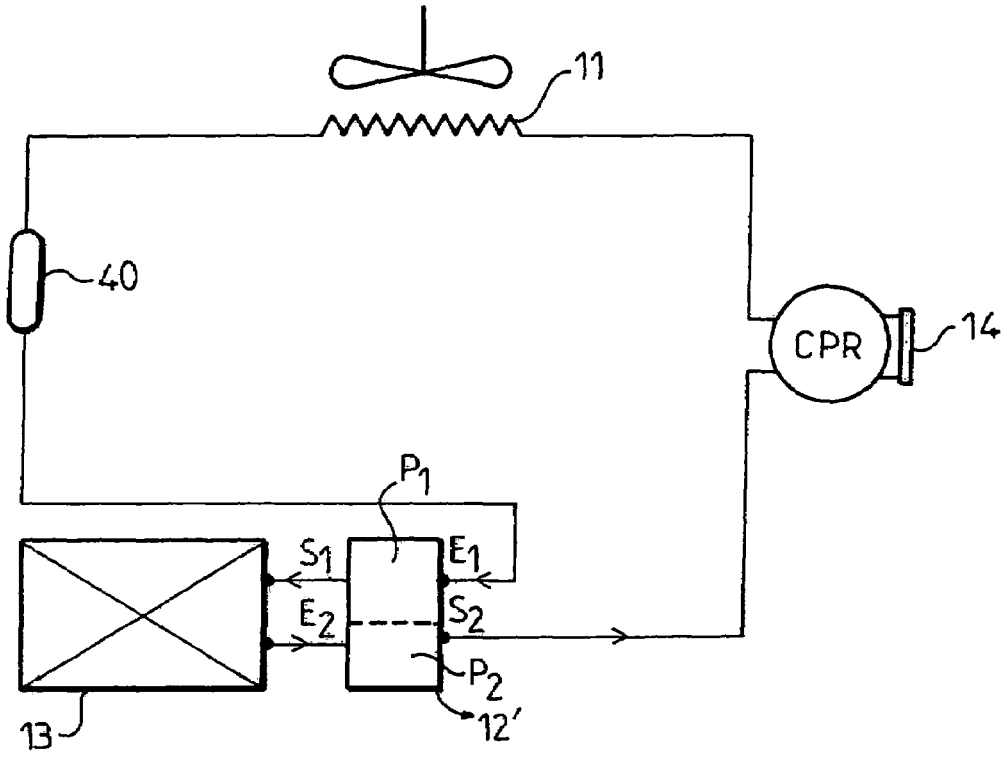
FIG.1A PRIOR ART
FIG. 1*a* represents a view in section of a thermostatic pressure reducer known from prior art.
Figure 1B:
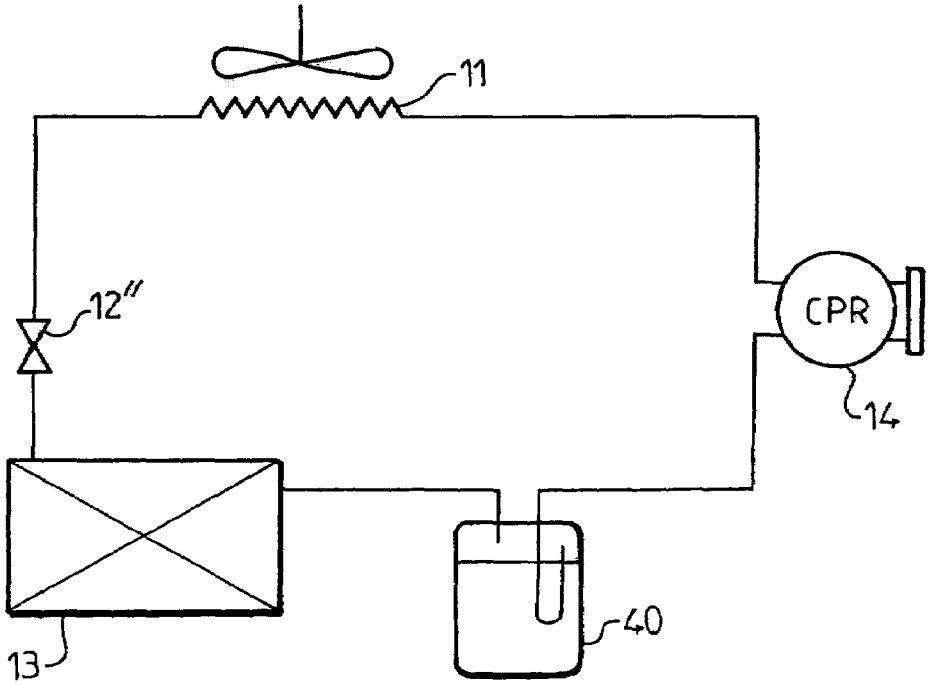
FIG.1B PRIOR ART
FIG. 1*b* represents a view in section of a calibrated orifice known from prior art.

Let us first consider FIGS. 1*a* and 1*b* which represent pressure reducers known from prior art.

FIG. 1*a* represents an air conditioning circuit known from prior art in which the pressure-reducing device 12' is a thermostatic pressure reducer. Such a pressure reducer regulates the flow of cooling fluid, thanks to a bulb placed in the path of cooling fluid at the outlet of the evaporator 13. The pressure-reducing device 12' includes a first part P1 which receives cooling fluid from the condenser 11 by means of the inlet E1 and transmits it to the evaporator by means of the outlet S1 through an opening with a variable passage section. The pressure-reducing device 12' further includes a second part P2 that receives the cooling fluid from the outlet of the evaporator 13 by means of the inlet E3 and transmits it to the compressor 14 by means of the outlet S2. This second part houses the bulb which is traversed by the cooling fluid originating from the evaporator outlet. The bulb is connected to a membrane on which it exerts a pressure as a function of overheating conditions. This membrane can then be moved to modify the passage section of the opening between the second part P2 and the first part P1. The structure of such a pressure reducer necessitates special and costly connections with the evaporator 13.

FIG. 1*b* represents an air conditioning circuit containing a calibrated orifice 12", known from prior art, for the purpose of the pressure reduction. The calibrated orifice 12" presents a simple structure which does not necessitate complicated connections to other circuit elements. However, it is not capable of regulating the flow of cooling fluid as a function of operating conditions. Moreover, its performance is not sufficient to avoid the surges of liquid at the compressor 14, so that it is often necessary to add a voluminous accumulator 40 at the outlet of the evaporator 13, which increases the overall dimensions of the air conditioning circuit.

Figure 2A:
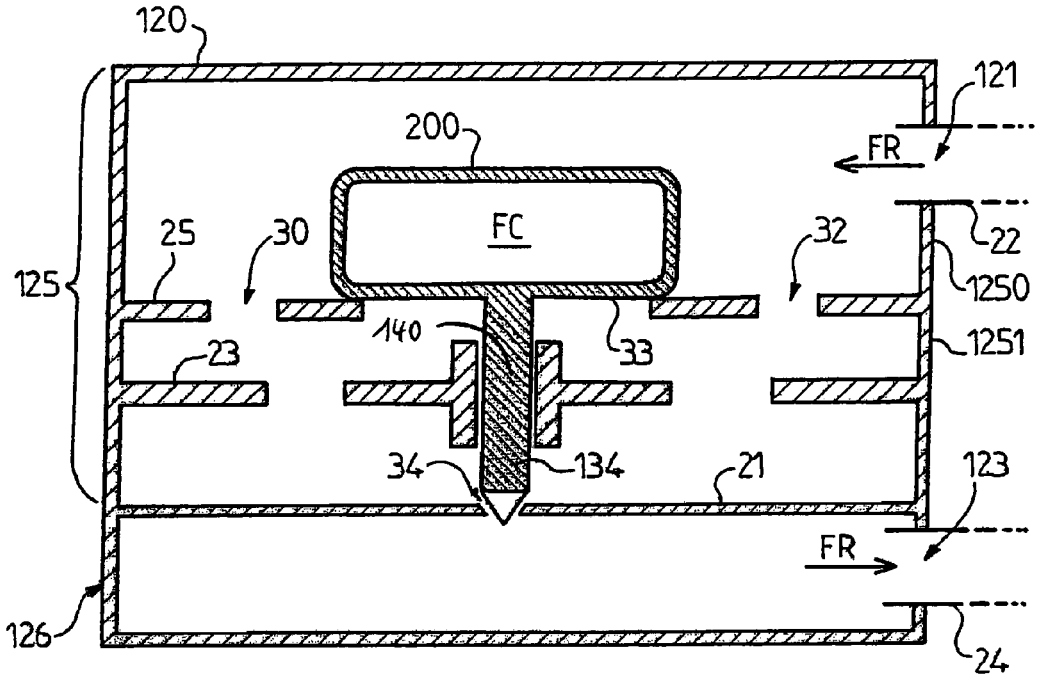
FIGS. 2*a* to 2*c* represent a pressure-reducing device according to the invention in various operating states.

Let us now refer to FIG. 2*a* which represents a pressure-reducing device according to the invention, designated as a whole by reference number 12. This pressure-reducing device is designed to be installed in an air conditioning installation.

The pressure-reducing device 12 includes a housing 120 which can be parallelepiped in its general shape and which is made, for example, of aluminum. The housing 120 is fitted with an inlet 121 suitable for receiving a cooling fluid FR at high pressure. The inlet is intended to be connected to a condenser by means of a connection conduit 22. Of course, the connection between pressure reducer and the condenser via the connection conduit 22 can be indirect when other circuit elements, for example an internal heat exchanger, are used on the condenser-evaporator line. The rest of the description will refer to an air conditioning installation which does not use any intermediate circuit element between the condenser and the pressure reducer, by way of non-limiting example.

The housing 120 moreover includes an outlet 123 from which the cooling fluid FR empties in a state of low pressure. This outlet is intended to be connected to the evaporator 13 by means of a connection conduit 24.

The inlet 121 and the outlet 123 are preferably arranged on the same lateral face of the housing 120. The pressure-reducing device is intended to be placed in an air conditioning circuit in which this lateral face is basically opposite the condenser.

The inlet 121 opens into a first compartment 125 delimiting a part of the extremity of the housing 120. The cooling fluid arriving in the inlet 121 is diverted into this first compartment 125.

The outlet 125 opens into a second compartment 126 delimiting another part of the extremity of the housing 120. The cooling fluid in this second compartment leaves the pressure reducer by means of the outlet 123.

The first compartment 125 can include an upper part 1250 and a lower part 1251. The upper part 1250 is separated from the lower part 1251 by a wall 25 provided with at least one opening 30 (or 32). In the example of the figure, two openings 30 and 32 are used in particular. The rest of the description will refer to this example, by way of illustration. The wall 25 constitutes an intermediate support for a bulb 200.

The cooling fluid arriving in the upper part 1250 by means of the inlet 121 can thus traverse the openings 30 and 32, in order to be distributed in the lower part 1251.

The second compartment is separated from the first compartment by another wall 21 fitted with a calibrated opening 34 with a passage section which can be regulated through the displacement of a needle valve 134.

The lower part 1251 of the first compartment has a wall 123 fitted with openings for the passage of cooling fluid. This wall is arranged on both sides of the needle valve 134 to support it.

The needle valve 134 can be constituted as a basically vertical control rod (140), known as a pressure-reducing rod, which can be moved in translation in a direction generally perpendicular to the respective axes of the inlet 121 and the outlet 123, especially in a vertical direction. The extremity of the needle valve is shaped as a function of the diameter of the opening 34.

The wall 21 is funnel-shaped at the level of the opening 34, in order to keep the needle valve in the second compartment.

The pressure-reducing device moreover includes a bulb 200 which encloses a small volume filled with a control fluid FC, which is basically of the cooling fluid type. The enclosure is a rigid cell integral with the wall 25. The lower part of the bulb is comprised by a flexible membrane 33 connected to the needle valve 134.

The fluid FC has a specific saturation pressure/temperature characteristic. It is specifically selected such that its saturation curve is below the saturation curve of the cooling fluid FR in the saturation pressure/temperature diagram. An especially adapted cooling fluid/control fluid combination is the R134*a*/R218 combination. It is equally possible to use the R134*a*/R134*a* combination.

The rest of the description will refer to control fluid R218 as a non-limiting example.

The bulb is placed in the first compartment so as to be in contact with the membrane 33. The bulb is washed against by the cooling fluid FR that arrives in the first compartment 125.

The control fluid will exert a pressure on the flexible membrane 33. The membrane can then be moved vertically in translation as a function of the forces acting upon it.

The temperature of the control fluid FC in the bulb depends upon the temperature of the refrigerating liquid FR arriving in the pressure-reducing device and corresponding to the temperature of the condenser outlet (or of the internal heat exchanger when the installation is equipped with one) which enables the movement of the needle valve 134 to be controlled.

In the embodiment where the R134*a*/R218 combination is used, it is possible to use, as a supplement, a system of springs to facilitate opening of the needle valve. For example, with reference to FIG. 2*d*, the membrane can be connected to a system of springs including a first helicoidal spring 350 connected to one part 250 of the wall 25 located in the vicinity of the needle valve to the left, and a second helicoidal spring 351 connected to one part 251 of the wall 25 located in the vicinity of the needle valve to the right. The system of springs is arranged to pull the needle valve up so as to promote opening of the section 34. Other systems of springs can be used, provided that the force which they exert is opposed to the force exerted by the control fluid FC on membrane 33. The tension of the springs is selected to be weak enough not to keep the needle valve open when the outside temperature is low, that is, when the thermal load on the loop is weak.

Figure 3:
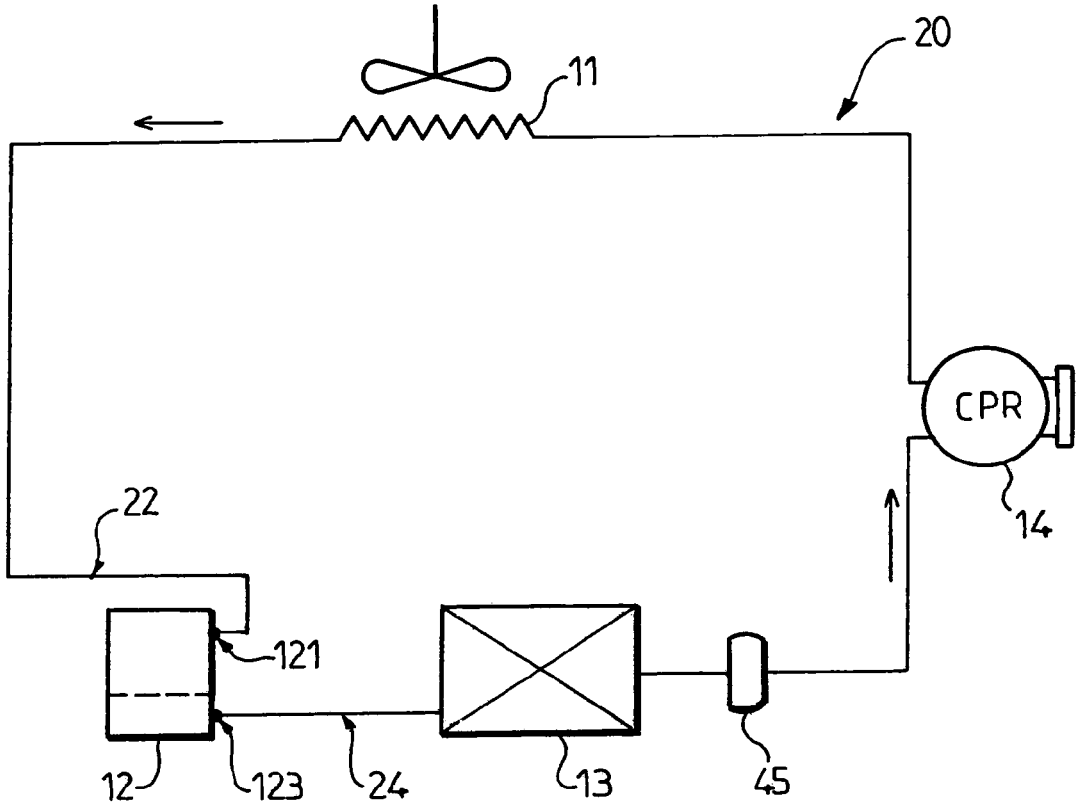
FIG. 3 represents an air conditioning circuit equipped with a pressure-reducing device according to the invention.

Let us now refer to FIG. 3 which represents an air conditioning circuit 20 suitable for installation in a motor vehicle to assure air conditioning of the cabin.

The circuit 20 includes a compressor 14, a condenser 11, a pressure-reducing device 12 according to the invention and an evaporator, traversed in that order by a cooling fluid FR, for example the fluid R134*a*. The cooling fluid FR is compressed in a gaseous state and brought to a high pressure HP by compressor 14. It is subsequently transformed into a liquid phase by the condenser 11, then subjected to a loss of pressure while passing into the pressure-reducing device 12. The liquid is partially evaporated in the pressure-reducing device 10 while cooling. At the outlet of the pressure-reducing device, the coolant is in the form of a mixture of vapor and of liquid at low pressure BP which is transmitted to the evaporator where it is transformed into a gaseous state.

The condenser is traversed by a flow of air which is heated on contact while the evaporator is traversed by a flow of air which is cooled upon contact and which is intended for air conditioning of the motor vehicle cabin.

The pressure-reducing device 12 according to the invention can be simply connected in a simple manner to the condenser 11 and the evaporator 13, because it has only one inlet 121 and one outlet 123.

In the condenser 11, the cooling fluid FR is first subjected to de-overheating at constant pressure to lower the temperature of the fluid, and then to condensation at constant pressure. Finally, the fluid FR is subcooled, in order to be able to input the pressure reducer with 100% fluid. The subcooling ΔS thus corresponds to the difference between the saturation temperature $T_{sat}$ of cooling fluid FR and the temperature at the inlet of the pressure reducer $T_{in}$ in accordance with the equation below:

$$\Delta S = T_{sat}(P_{in}) - T_{in},$$

where the saturation temperature $T_{sat}$ of the cooling fluid FR depends on the pressure Pin of the cooling fluid upon entering the pressure-reducing device.

At strong loads, a subcooling value ΔS on the order of 10° C. allows proper operation of the air conditioning circuit and offers better thermal performances.

As indicated previously, the pressure of the control fluid FC in the bulb 200 depends on the temperature characteristics of the cooling fluid FR originating from the condenser and thus upon the subcooling ΔS. This means the control pressure Pc exerted by the liquid FC on the membrane 33 has a value related to the subcooling ΔS.

The variations in this control pressure Pc enable variation of the passage section of the calibrated opening 34.

Thus, the pressure-reducing device according to the invention permits regulating the flow of cooling fluid as a function of subcooling ΔS at the condenser outlet.

The vertical movement of the needle valve 134 represented in FIG. 2*a* is regulated by the temperature of the cooling fluid FR upon arriving in the pressure-reducing device by inlet 121. In fact, the control fluid FC in the interior of the bulb is subjected to a thermal exchange with the cooling fluid FR arriving in the first compartment 125. The control fluid FC has a characteristic pressure saturation/temperature ratio higher or equal to that of the cooling fluid FR and in consequence, at a given temperature, the control fluid FC has a different pressure than that of the cooling fluid FR.

Figure 5A:
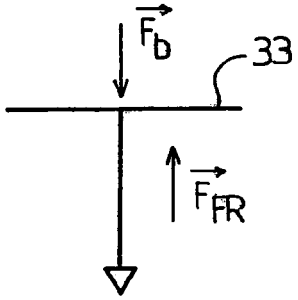
FIG. 5*a* is a schematic diagram representing the various pressures being exerted on the bulb membrane according to the device of the invention.

Let us refer to FIG. 5*a* which represents the balance of forces which are exerted upon the membrane 33. The functioning of the pressure-reducing device is determined by the following forces:

- the force fb due to the action of the control pressure Pc of the bulb on the membrane,
- the force $f_{FR}$ exerted by the pressure of the cooling fluid FR on the membrane 33.

Figure 2B:
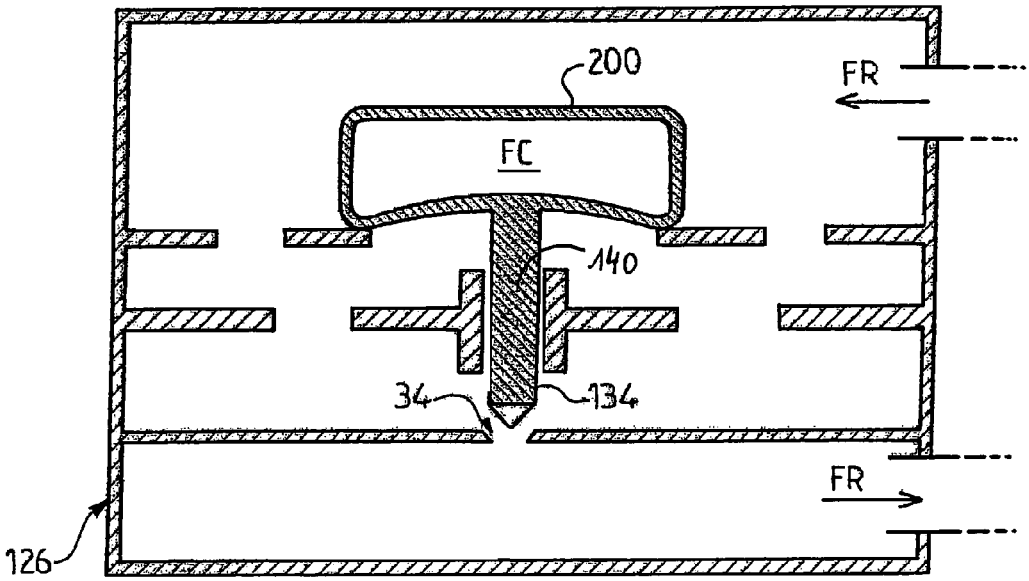
Figure 2C:
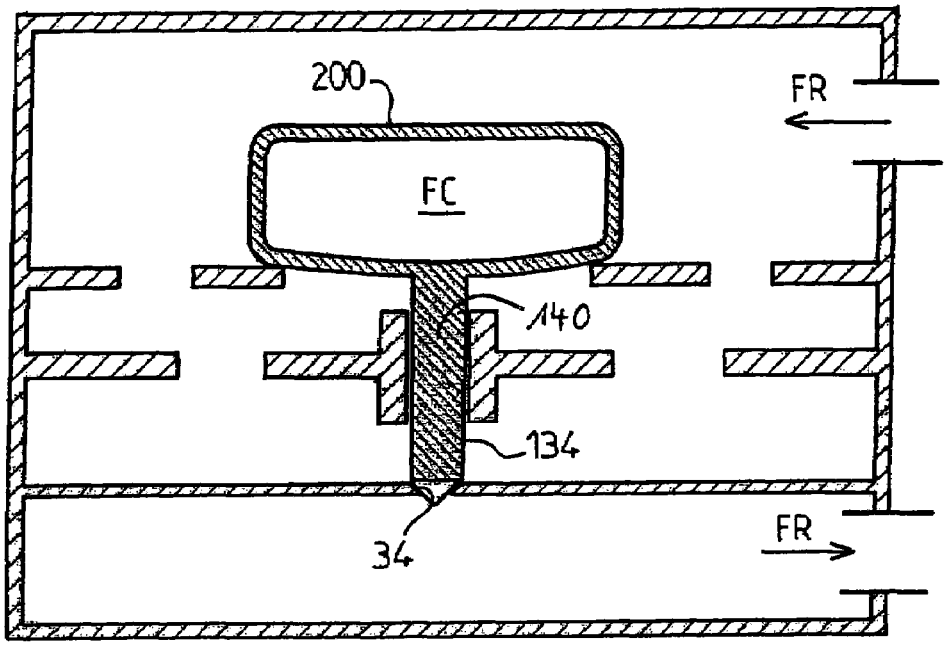
Figure 2D:
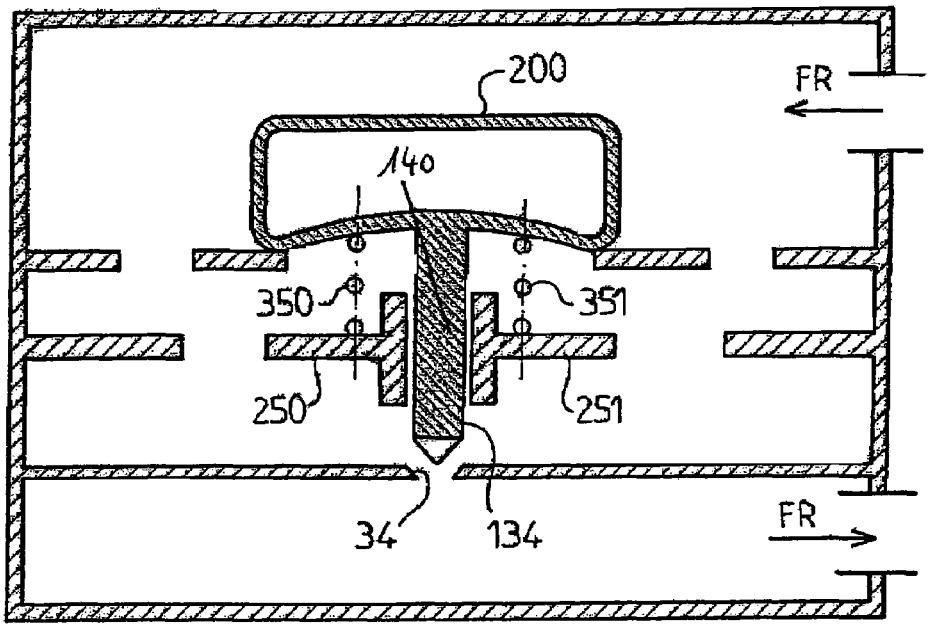
FIG. 2*d* represents a pressure-reducing device according to a variant embodiment of the invention.
Figure 5B:
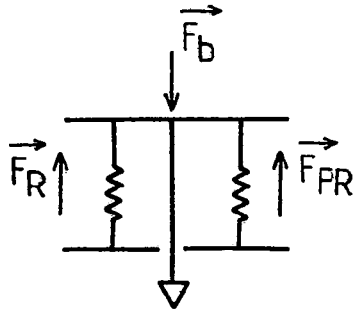
FIG. 5*b* is a schematic diagram representing the various pressures being exerted on the bulb membrane according to the variant construction of FIG. 2*d*.

FIG. 5*b* represents the balance of forces exerted on the membrane 33 in accordance with the pressure-reducing device of FIG. 2*d*, using a system of springs (350, 351). In such a pressure-reducing device, the membrane 33 is subjected to the following forces:

- the force fb due to the action of the control pressure Pc of the bulb on the membrane,
- the force $f_{FR}$ exerted by the pressure of the cooling fluid FR on the membrane 33,
- the force fr of thrust of the system of springs (350, 351).

The force F1=$f_{FR}$+fr (with fr=0 in the absence of the system of springs) acts in the opening direction of the needle valve and the force F2=fb acts in the closing direction of the needle valve. As long as the three forces are in equilibrium, the passage section for the cooling fluid remains closed. FIG. 2*a* corresponds to the aforesaid state of equilibrium.

If force F1 is greater than force F2, the needle valve 134 goes in the opening direction of the passage section 34, as represented in FIGS. 2*b* and 2*d*. Conversely, if force F1 is less than force F2, the needle valve 134 goes in the closing direction of the passage section 34, as represented in FIG. 2*c*.

The pressure-reducing device 12 enables subcooling to be imposed at the outlet of the condenser 11.

An excessively great subcooling ΔS indicates that the last molecule of gas is condensing too soon in the condenser. In that case, the control pressure in the bulb is very low, which entails opening of the passage section 34. The result is a high flow rate of cooling fluid at the evaporator inlet and thus a high refrigerating power.

An excessively weak subcooling ΔS does not enable 100% fluid input to the pressure reducer. In that case, the control pressure in the bulb is high, which entails closing of the passage section 34. There results a very weak flow of cooling fluid upon entering the evaporator. The refrigerating power is good, but the compressor 14 risks surges of liquid.

Thus the pressure-reducing device according to the invention imposes a relationship between the opening of the passage section 34 and the subcooling AS. In particular, this property may be used to set the subcooling.

In FIG. 2*b*, the liquid FR arriving in the first compartment 125 is subjected to subcooling in the condenser and, by consequence, the cooling fluid FR is almost entirely in a liquid state at low temperature. The pressure of the control fluid FC is thus low in relation to the pressure being exerted on the exterior of the bulb 200. As a consequence, the force F2=fb is less than the force F1=$f_{FR}$+fr. The membrane will then be deformed toward the interior of the bulb, entailing a translation of the needle valve upward which induces the opening of the passage section 34 and permits a significant flow rate of the cooling fluid FR at the outlet 123 of the pressure-reducing device. The opening of the passage section subsequently induces a reduced subcooling.

Conversely, under certain operating conditions, it can be interesting to induce subcooling. With reference to FIG. 2*c*, the cooling fluid FR arriving in the compartment 125 has not been subjected to subcooling or has been subcooled to only a slight degree in the condenser 11, and as a consequence the cooling fluid has an elevated temperature. The control fluid FC in the bulb 200 reacts to this temperature by expanding slightly. The pressure in the bulb is thus slightly greater than or equal to the pressure being exerted around the bulb 200, and the force F2+fb becomes greater than or equal to the force F1=$f_{FR}$+fr. The membrane 33 is deformed toward the exterior and entails a downward translation of the needle valve 134 which induces the closing of the passage section 34. This will give rise to the creation of subcooling in the condenser 11.

In normal operation, it is thus the pressure reducer which will regulate or impose the subcooling in the condenser.

According to an additional aspect of the invention, the control fluid FC is selected so that its saturation curve is below the saturation curve of the cooling fluid FR, in the pressure saturation/temperature diagram represented in FIG. 4. The subcooling is then basically constant under conditions of heavy loads.

Figure 4:
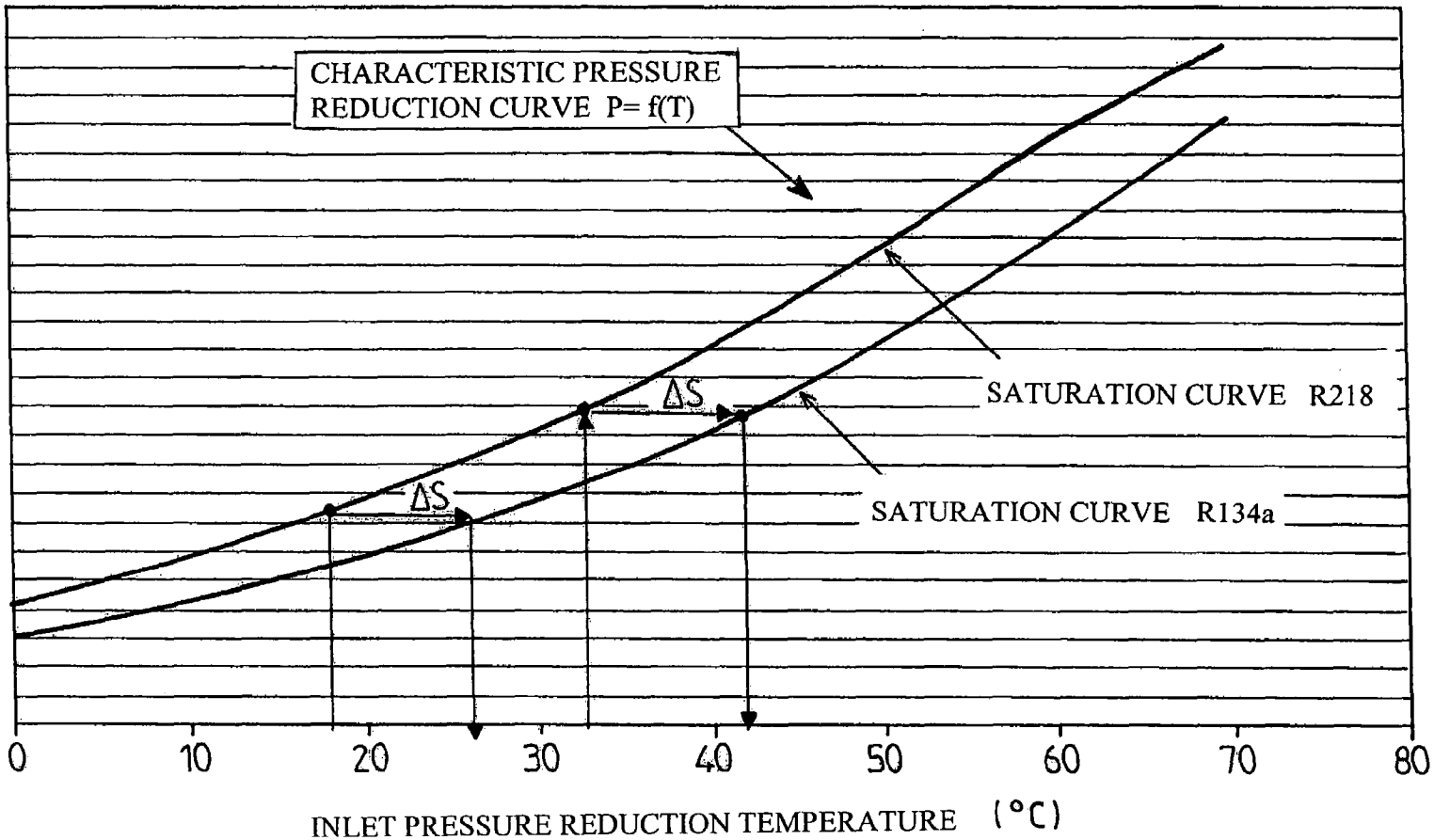
FIG. 4 is a diagram representing the ideal saturation pressure/temperature characteristics of a control fluid that can be used in the pressure-reducing device according to the invention.

With reference to FIG. 4, the higher saturation diagram corresponds to the control fluid R218 and the lower saturation diagram corresponds to cooling fluid R134*a*. The subcooling ΔS then represents, for a given pressure, the difference between the temperature corresponding to that pressure on the lower saturation curve and the temperature corresponding to that pressure on the upper saturation curve.

In FIG. 4, we observe that the higher and lower saturation curves are basically parallel between 10° C. and 10° C. The difference in saturation pressure between the cooling fluid and the control fluid—and thus the subcooling—is thus basically constant over this range of temperatures. These characteristics result from the cooling fluid FR/control fluid FS combination utilized (R134*a*/R218).

Thus, by imposing suitable operating conditions, it is possible to maintain a selected subcooling, for example 10° C. at the condenser outlet, and thus to optimize the operation of the air conditioning loop.

For example, it is possible to place a probe in the bulb 200 to measure the temperature of the control fluid FC and another probe in the first compartment to measure the temperature of the cooling fluid FR. It is thus possible to calculate the difference between the two temperatures measured at a given instant which provides the value of the subcooling ΔS. If the subcooling is too significant, it is possible to act on the subcooling regulation screw, in order to increase the opening of the passage section 34.

In addition, the air conditioning circuit can include an accumulator 45 at the evaporator outlet or at the compressor inlet to avoid surges of the liquid. Such an accumulator 45 is not indispensable to the operation of the air conditioning installation according to the invention, and constitutes n more than a supplemental safety feature. Moreover, this accumulator can be small in size because it is not designed to contain the non-circulating part of the cooling fluid, which is processed in the subcooling area of the condenser.

The pressure-reducing device according to the invention thus makes it possible to create a drop in cooling fluid pressure between the inlet 123 and the outlet 124 while maintaining a subcooling suitable for guaranteeing proper operation of the air conditioning loop.

It moreover controls the flow of cooling fluid as a function of the calorific load emitted by the condenser which varies according to the operating conditions.

Its structure implies simple and low-cost connections for an installation in an air conditioning circuit.

In particular, the connection of the pressure reducer to other elements of the circuit can be realized by a single-tube clamp maintained, for example, by a screw. Such a system of connection is customarily used in pressure reducers with a calibrated orifice.

Moreover, the regulation performance provided by this pressure-reducing device is such that it is not necessary to have a voluminous accumulator.

Such a pressure-reducing device thus meets the cost and volume requirements of an air conditioning installation.

What is claimed is:

1. Pressure-reducing device designed to be installed in an air conditioning circuit operating with a cooling fluid (FR), and including a housing suitable for being traversed by the cooling fluid under the control of a needle valve (134), said device separated into two compartments, a first compartment 125, and a second compartment 126, said first compartment 125 separated into an upper part 1250 and lower part 1251 by a wall 25 provided with at least one opening, said pressure-reducing device furthermore including a bulb (200) filled with a control fluid exerting a pressure on a membrane (33) as a function of ambient conditions, the membrane being suited to act on the needle valve (134) as a function of the control pressure, wherein the bulb is placed in the path of the cooling fluid in the pressure-reducing device.

2. Pressure-reducing device according to claim 1, wherein the control fluid presents a saturation pressure higher that the saturation pressure of the cooling fluid at a given temperature and wherein the wall 25 constitutes an intermediate support for bulb 200.

3. Pressure-reducing device according to claim 2, wherein the difference in pressure between the cooling fluid (FR) and the control fluid (FC) is basically constant on a temperature scale between 10° C. and 70° C.

4. Pressure-reducing device according to claim 2, wherein the control fluid is the fluid R218.

5. Pressure-reducing device according to claim 2, wherein the control fluid is the fluid R134*a*.

6. Pressure-reducing device according to claim 1, wherein the housing includes an inlet (121) suitable for being connected to a condenser by a conduit to receive the cooling fluid and an outlet suitable for being connected to the evaporator by another conduit to transmit cooling fluid to it.

7. Pressure-reducing device according to claim 6, wherein the housing includes a first compartment from which the inlet (121) opens and a second compartment from which the outlet (123) opens, the cooling fluid being transmitted from the first compartment to the second compartment by an opening, the passage section whereof is adjusted by the needle valve (134).

8. Pressure-reducing device according to claim 7, wherein the bulb is located in the first compartment.

9. An air-conditioning circuit pressure-reducing device according to claim 8, wherein the needle valve (134) is located in the first compartment beneath the bulb (200) and wherein it includes a control rod connected mechanically to the membrane such as to be mobile in translation as a function of the pressure exerted by the control fluid on the membrane (33).

10. Air conditioning circuit operating with a cooling fluid and including a compressor (14), a condenser (11), a pressure-reducing device (12) and an evaporator (13), wherein the pressure-reducing device is such as defined in claim 1, its inlet being connected to the condenser (11) and its outlet being connected to the evaporator (13).

11. Air conditioning circuit according to claim 10, wherein said circuit includes an accumulator placed between the evaporator outlet and the compressor inlet.

* * * * *